US007850250B1

(12) United States Patent
Sollami

(10) Patent No.: US 7,850,250 B1
(45) Date of Patent: Dec. 14, 2010

(54) TOOL BODY FOR ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 12/199,128

(22) Filed: Aug. 27, 2008

(51) Int. Cl.
*E21C 35/18* (2006.01)

(52) U.S. Cl. ..... 299/110

(58) Field of Classification Search ..... 299/100–113, 299/81.1–81.3
See application file for complete search history.

(56) References Cited

U.S. PATENT DOCUMENTS 4,684,176 A * 8/1987 Besten et al. ..... 299/107
4,755,003 A * 7/1988 Pinkerton et al. ..... 299/107
4,921,310 A * 5/1990 Hedlund et al. ..... 299/107
6,357,832 B1 * 3/2002 Sollami ..... 299/104
6,644,755 B1 * 11/2003 Kammerer ..... 299/104
7,475,948 B2 * 1/2009 Hall et al. ..... 299/104
2002/0175555 A1 * 11/2002 Mercier ..... 299/107
2006/0279134 A1 * 12/2006 Frear ..... 299/106
2008/0036276 A1 * 2/2008 Hall et al. ..... 299/104

* cited by examiner

*Primary Examiner*—Sunil Singh
(74) *Attorney, Agent, or Firm*—Robert L. Marsh

(57) ABSTRACT

A rotatable tool has a tool body that is generally symmetrical about a longitudinal axis, an enlarged cutting head, and a rearwardly extending shank. The shank joins the enlarged cutting head at an annular flange having an annular inner portion contiguous with the forward end of the shank and an annular outer portion contiguous with the outer circumference of the enlarged cutting head. The annular flange is not planar. Instead, the annular inner portion of the flange is positioned axially forward of the annular outer portion.

2 Claims, 2 Drawing Sheets

TOOL BODY FOR ROTATABLE TOOL

The present invention relates to rotatable tools for cutting machines and in particular to an improved tool body that aids in rotation of such tools.

BACKGROUND OF THE INVENTION

Machines that cut hard surfaces such as used in the trenching and mining industries, and that remove hard surfaces of concrete and asphalt prior to repaving a roadway require rotatable tools mounted in a wheel or rotatable drum. The tools have a tapered forward cutting end and axially located behind the cutting end is a cylindrical shank that rotatably fits within a complementary shaped bore of a tool holder. Between the forward cutting end and the shank, the tool has a rearwardly directed annular flange that contacts the forward surface of the tool holder. Force is applied through the rotatable drum or wheel to the tool holder and through the radial flange to the tool to thereby force the tool into the hard surface to be cut. The tools are mounted on the drum at an angle such that rotation of the drum causes rotation of the tools with the annular flange rotating against the planar surface of the tool holder.

To prevent wear to the forward end of the tool holder it has become customary to provide a wear ring that fits around the circumference of the shank of the tool with one surface of the wear ring engaging the annular flange of the tool and the other surface engaging the forward surface of the tool holder. The useful life of a tool used in road planing is at most one day during active use of the machine. It is therefore common to replace all the tools of a road planing machines at least daily. When the tool is replaced, the wear ring is also replaced such that the contact is between the annular flange of a new tool and the forward surface of a new wear ring.

In order for the parts to work properly, it is desirable that the wear ring itself be non-rotatable with respect to the tool holder. There are several methods employed for preventing rotation of the wear ring with respect to the tool holder, one of which is described in my U.S. Pat. No. 7,229,136 B2 issued Jun. 12, 2007, which is incorporated herein by reference. Another structure is shown in Britzke, U.S. Pat. No. 5,931,542.

The tool further has a hardened forward tip that engages the hard surface to be cut. The rotation of the tool causes the forward cutting end of the tool to become worn symmetrically around its longitudinal axis. The rotation of the tool is therefore necessary to sharpen the hardened tip. Where the wear ring fails to rotate properly, the forward cutting end will wear unevenly and the hardened tip will gradually become blunted or develop a flat surface and the useful life of the tool will become shortened.

The frictional force generated between the forward surface of the non-rotatable wear ring and the rearward surface of the rotating annular flange of the tool inhibits rotation of the tool. It is therefore desirable to minimize the resistance forces between the wear ring and the annular flange.

The annular flanges of all tool holders are planar and oriented perpendicular to the longitudinal axis of the tool body. The forward surfaces of existing wear rings are also planar such that two planar surfaces are in uniform contact with each other as the tool rotates.

Not withstanding all the above, tool failure continues to occur as a result of inadequate rotation of the tool within the tool holder. It is therefore desirable to minimize the resistance between the rearward surface of the annular flange and the forward surface of the wear ring wherever possible.

SUMMARY OF THE INVENTION

Briefly, the present invention is embodied in a rotatable tool for insertion in a bore of a tool holder where the tool has an enlarged cutting head and extending rearwardly of the enlarged cutting head, a cylindrical shank. Fitted at the forward end of the enlarged cutting head is a hardened tip and fitted around the circumference of the shank is a compressible retainer sleeve and an annular wear ring having a planar forward surface for contacting a portion of an annular flange at the rearward end of the enlarged cutting head of the tool.

In accordance with the invention, the annular flange that defines the rearward end of the enlarged cutting head has a first annular portion that is contiguous with the forward end of the shank and a second annular portion that is radially outward of the first annular portion and is contiguous with the outer diameter of the enlarged cutting head. The first annular portion is positioned axially forward of the second annular portion such that the annular flange is not planar. Accordingly, when the tool is inserted into the wear ring only, the second annular portion that extends around the outer circumference of the flange makes contact with the forward surface of the wear ring whereas the first annular portion which is positioned axially forward of the second annular portion is spaced from the forward surface of the wear ring. As a result of the forgoing, only the outermost perimeter of the rearwardly facing radial flange makes contact with the wear ring thereby reducing the area of contact and thereby reducing the frictional resistance of the rearwardly facing flange against the wear ring.

In one embodiment of the invention, the annular midportion between the first annular portion and the second annular portion is frustoconical with the wall of the frustoconical surface defining an angle with a plane perpendicular to the axis of the tool. I have found that only a small angle between the frustoconical surface and the plane perpendicular to the axis is needed with the preferred angle being about four degrees.

In a second embodiment, the first annular portion of the flange is countersunk with respect to the second annular surface of the flange.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENTS

Figure 1:
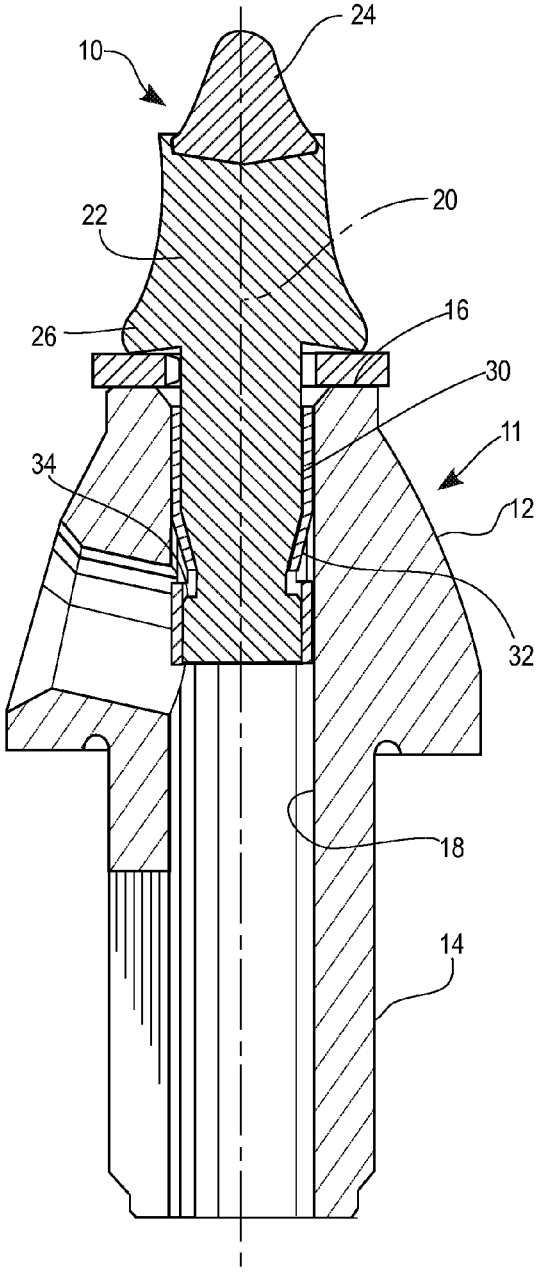
FIG. 1 is a cross-sectional view of a tool and wear ring in accordance with the invention inserted into the forward end of a tool holder.
Figure 2:
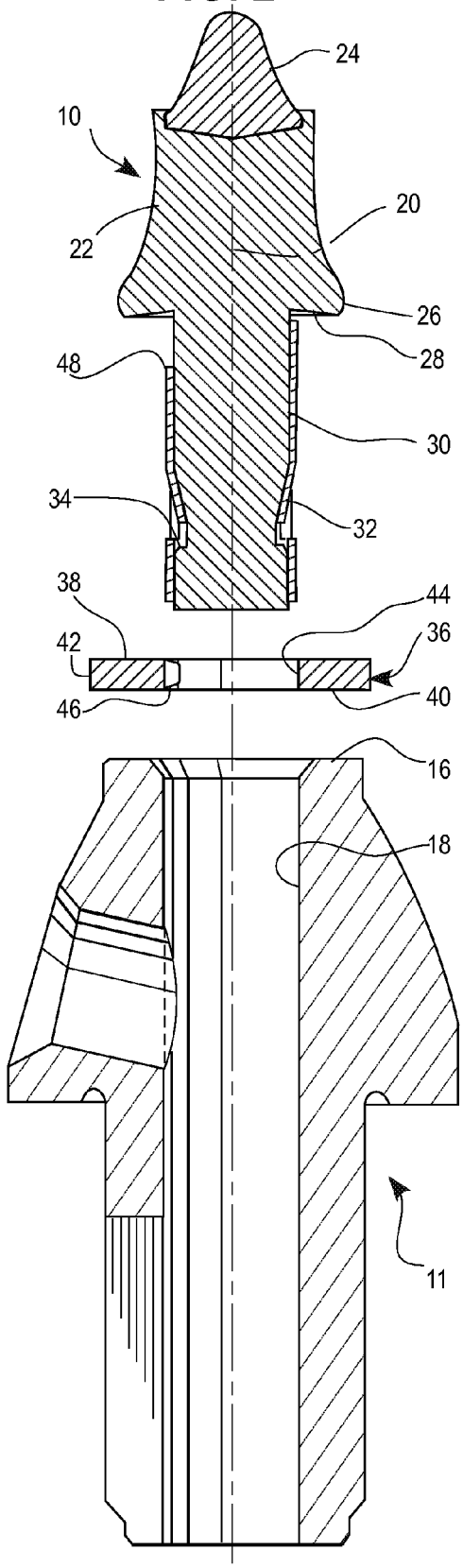
FIG. 2 is an exploded cross-sectional view of the parts shown in FIG. 1.
Figure 3:
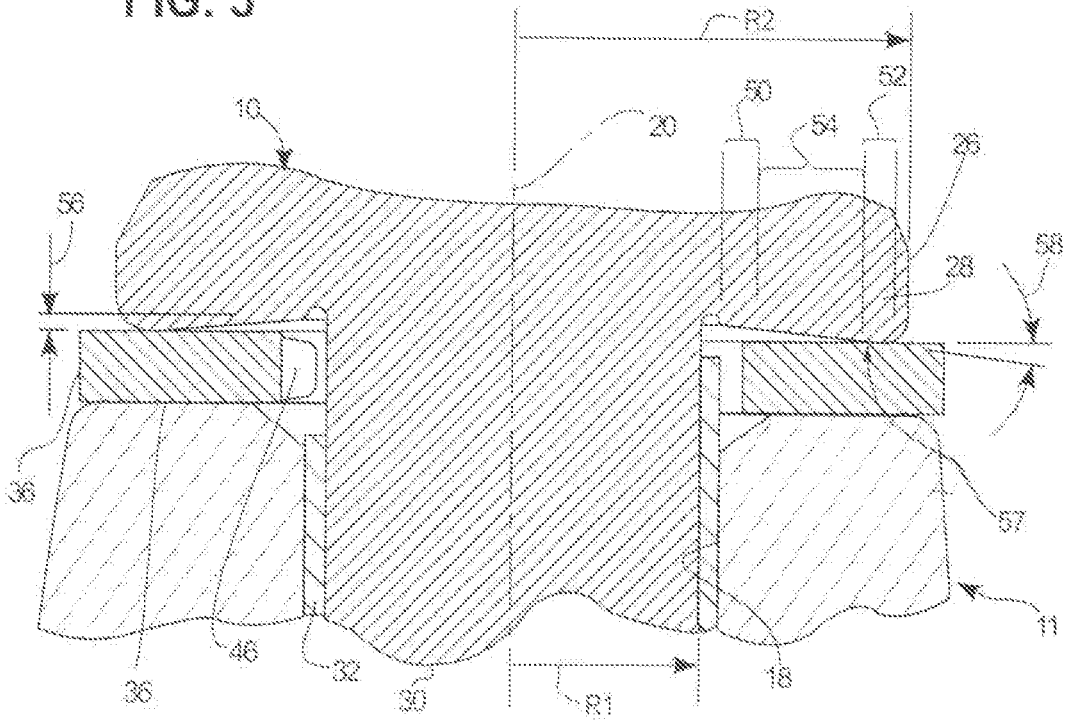
FIG. 3 is a fragmentary enlarged cross-sectional view showing the annular flange of the tool and forward surface of the wear ring shown in FIG. 2.

Referring to FIGS. 1, 2, and 3, a tool 10 in accordance with the present invention is suitable for mounting in a tool holder 11. Where the tool holder 11 is a quick-change tool holder such as described in my previous U.S. Pat. Nos. 6,371,567

B1, 6,585,326 B2 and 6,685,273 B1, the text of which are both incorporated herein by reference, the tool holder 11 has an enlarged forward portion 12 and extending rearwardly of the enlarged forward portion 12 is a tubular rearwardly extending shank 14 for attachment to a base block unit, not shown, which in turn is welded to the drum of a machine, also not shown. The tool holder 11 also has a generally planar forward surface 16 and a bore 18, the axis of which is perpendicular to the planar forward surface 16.

The tool 10 is generally symmetrical about a longitudinal axis 20 and includes an enlarged forward cutting head 22 at the very forefront of which is a hardened tip 24. The enlarged forward cutting head 22 diverges radially outwardly from the tip 24 to a maximum diameter 26 at the rearward end thereof with a rearward surface forming an annular flange 28. Extending axially from the center of the annular flange 28 is a cylindrical shank 30. Fitted around the cylindrical shank 30 is a compressible sleeve 32 that is retained to the shank by an annular ridge 34 at the distal end thereof. Fitted around the circumference of the shank 30 and the forward end of the sleeve 32 is an annular wear ring 36.

The wear ring 36 has a generally planar forward surface 38 that contacts the rearward surface of the flange 28, a parallel planar rearwardly facing surface 40 that contacts the forward surface 16 of the tool holder 11, a cylindrical outer wall 42, and a generally cylindrical central opening 44. Preferably, the compressible sleeve 32 and wear ring 36 are of the type disclosed in my previously issued U.S. Pat. No. 7,229,136 B2 such that the wear ring 36 is retained against rotation with respect to the sleeve 32 by means of a projection 46 on the inner opening 44 of the wear ring 36 that extends into a cut out portion 48 in the compressible sleeve 32. My U.S. Pat. No. 7,229,136 B2 is incorporated herein by reference to provide a more comprehensive description of these parts.

When the wear ring 36 and sleeve 32 are fitted around the shank 30 of the tool 10 and the shank 30 is inserted into the bore 18 of the tool holder 11, the compressible sleeve 32 will retain the shank 30 of the tool 10 within the bore 18 and will simultaneously retain the wear ring 36 against rotation with the tool 10.

Referring to FIG. 3, in accordance with the present embodiment, the surface of the annular flange 28 is not planar. Instead, the flange 28 has an annular inner portion 50, the inner circumference of which is contiguous with the outer circumference of the cylindrical shank 30, and an outer portion 52, the outer circumference of which is contiguous with the maximum diameter 26 of the enlarged cutting head 22. Between the inner portion 50 and the outer portion 52, the surface of the annular flange has an annular midportion 54 which extends between the outer circumference of the inner portion 50 and the inner circumference of the outer portion 52. In accordance with the invention, the inner portion 50 is positioned axially forward of the outer portion 52 by a short distance 56. I have found that the distance 56 between the axial positions of the inner portion 50 and outer portion 52 need only be a small distance of perhaps 0.020 of an inch. In the embodiment depicted in FIG. 3, the annular midportion 54 which transits the distance 56 between the inner and outer portions 50, 52 is inversely frustoconical, that is a complementary surface that would mate with midportion 54 would be frustoconical. The inversely frustoconical surface 54 has an angle of incline 58. Preferably, a boundary 57 between the midportion 54 and the outer portion 52 has a radius that is greater than one-half the sum of the radius R1 of the cylindrical shank 30 and the radius R2 of the radial flange 28. I have found that an angle of incline 58 between one degree and five degrees is sufficient to significantly reduce the resistance to rotation of the annular flange 28 with respect to the forward surface 38 of the wear ring 36. I prefer an angle of incline 58 of four degrees.

Figure 4:
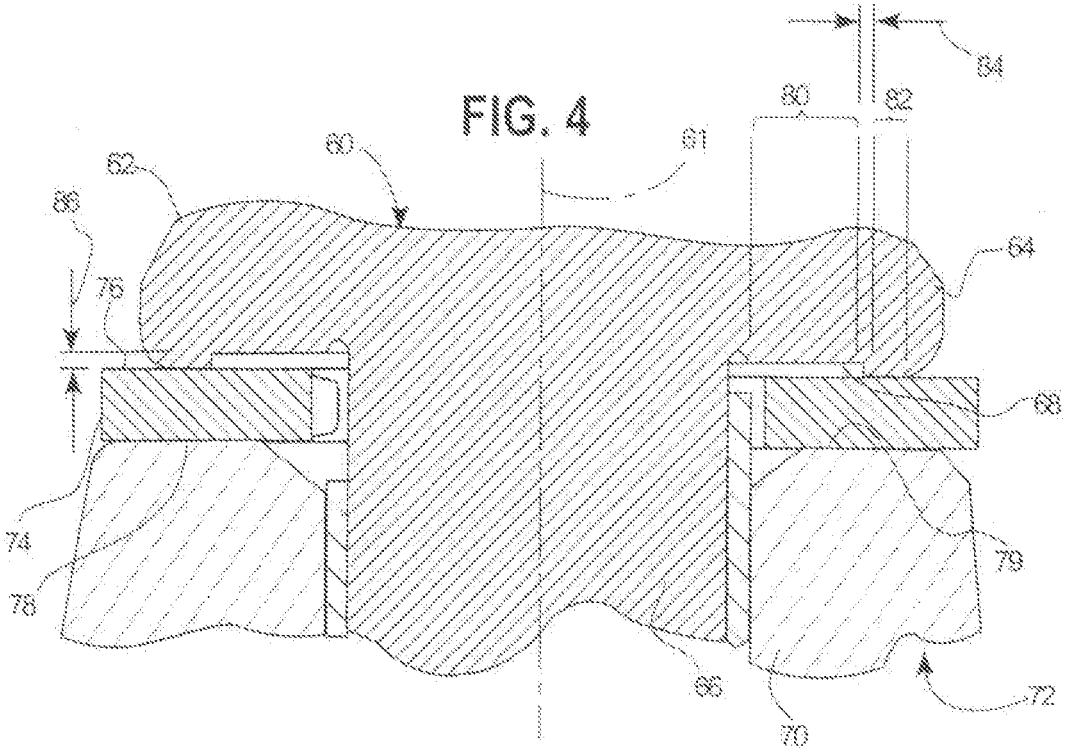
FIG. 4 is another fragmentary enlarged cross-sectional view of an annular flange of a tool engaging the forward surface of an annular wear ring in accordance with another embodiment of the invention.

Referring to FIG. 4 in which another tool 60 is depicted, the tool 60 being symmetrical about a longitudinal axis 61 and having a metal body 62 that includes an enlarged cutting head 64 and a rearwardly extending cylindrical shank 66. Extending between the forward end of the cylindrical shank 66 and the rearward end of the enlarged forward end 64 is a rearwardly facing annular flange 68. The cylindrical shank 66 of the tool 60 extends into a bore 70 of a tool holder 72 and an annular wear ring 74 having a planar forward surface 76 and parallel planar rearward surface 78 is fitted between the forward surface 79 of the tool holder 72 and the flange 68 of the tool 60.

In this embodiment, the annular flange 68 has an annular inner portion 80 that is contiguous with the cylindrical shank 66 and an annular outer portion 82, the outer circumference of which is contiguous with the maximum diameter of the enlarged cutting head 64. Between the inner portion 80 and the outer portion 82 is an annular midportion 84. As with the tool 10, the inner portion 80 of the annular flange 68 is positioned axially forward of the outer portion 82 with the midportion 84 spanning the distance 86 between the inner and outer portions 80, 82. In this embodiment, the annular inner portion 80 extends radially outward of the shank 66 to at least midway between the radius of the shank 66 and the maximum radius of the enlarged cutting head 64 with the surface of the inner portion 80 being generally planar. Similarly, the annular surface of the outer portion 82 is also planar with the midportion 84 defining an offset or countersink thereby spanning the axial distance 86 between the inner portion 80 and the outer portion 82.

When one of the tools 10, 60 is inserted into the bore of a tool holder, only the outer portions 52, 82 of the corresponding annular flange 28, 68 makes contact with the forward surface 38, 76 of the associated wear ring 36, 74. Accordingly, the surface area of contact between the two parts is reduced thereby substantially reducing the resistance to rotation. By reducing the resistance to rotation the effective useful life of the tool 10, 60 is enhanced.

Even though the offset 56, 86 is small, the rotation of the tool 10, 60 will not cause sufficient wear on the contacting surfaces 52, 82 to erode the offset 56,86 away because both the tool body 10, 60 and the associated wear rings 36, 74 are hardened. Typically, the tool bodies are made of AISI 15B35 steel hardened to 40 to 46 on the Rockwell "C" scale and the wear rings are made of AISI 1050 steel hardened to 43 to 50 on the Rockwell "C" scale. The tools and wear rings are therefore both discarded before the contacting surfaces become sufficiently worn to significantly increase friction.

While the present invention has been described with respect to two embodiments, it will be appreciated that many modifications and variations may be made without departing from the spirit and scope of the invention. It is therefore the intent of the appended claims to cover all such modifications and variations that fall within the spirit and scope of the invention.

What is claimed:

1. The combination comprising a tool holder having a planar forward surface and a cylindrical bore extending into a body of said tool holder, said cylindrical bore having an axis perpendicular to said forward surface, a rotatable tool having a tool body with a longitudinal axis, an enlarged cutting head and a cylindrical shank extending rearwardly of said enlarged cutting head, a hardened tip at a forward end of said enlarged cutting head, said shank joining said enlarged cutting head at an annular flange, said annular flange having a planar annular inner portion joining a forward end of said shank and a planar annular outer portion extending to a maximum diameter of said annular flange, said annular inner portion being axially forward of said annular outer portion, an annular midportion in the form of an offset extending between said planar annular inner portion and said planar annular outer portion, a wear ring around said shank, said wear ring independent of said tool holder, said wear ring having a planar forward surface, a planar rearward surface contacting said planar forward surface of said tool holder, and an outer edge joining said planar forward surface to said planar rearward surface, said planar forward surface of said wear ring including an annular inner portion spaced from said annular inner portion of said annular flange, and an annular outer portion contacting said outer portion of said annular flange wherein an open spacing remains between said annular inner portion of said planar forward surface of said wear ring and said planar annular inner portion of said annular flange.

2. The combination comprising a tool holder having a planar forward surface and a cylindrical bore extending into a body of said tool holder, said cylindrical bore having an axis perpendicular to said forward surface, a rotatable tool having a tool body with a longitudinal axis, an enlarged cutting head and a cylindrical shank extending rearwardly of said enlarged cutting head, said cylindrical shank having a first radium R1, a hardened tip at a forward end of said enlarged cutting head, said shank joining said enlarged cutting head at an annular flange, said annular flange having an annular inner portion joining a forward end of said shank and an annular outer portion extending to a maximum diameter of said annular flange, said annular flange having a second radius R2, said annular inner portion being axially forward of said annular outer portion, an inverse frustoconical midportion extending continuously from said annular inner portion of said flange to said annular outer portion of said flange, a boundary between said midportion and said annular outer portion having a radius that is greater than one-half of the sum of R1 plus R2, a wear ring around said shank, said wear ring independent of said tool holder, said wear ring having a planar forward surface, a planar rearward surface contacting said planar forward surface of said tool holder, and an outer edge joining said planar forward surface to said planar rearward surface, said planar forward surface of said wear ring having an annular inner portion spaced from said annular inner portion of said annular flange and an annular outer portion contacting said annular outer portion of said annular flange wherein an open spacing remains between said planar forward surface of said wear ring and said inverse frustoconical midportion of said annular flange.

* * * * *